United States Patent [19]

Kaczerwaski

[11] Patent Number: 4,720,872

[45] Date of Patent: Jan. 19, 1988

[54] THERMOPLASTIC BAG AND METHOD OF FORMING THE SAME

[75] Inventor: David J. Kaczerwaski, Manchester, N.Y.

[73] Assignee: Mobil Oil Corporation, New York, N.Y.

[21] Appl. No.: 940,231

[22] Filed: Dec. 11, 1986

Related U.S. Application Data

[63] Continuation of Ser. No. 738,629, May 28, 1985, abandoned.

[51] Int. Cl.[4] ..... B65D 30/20

[52] U.S. Cl. ..... 383/8; 383/120; 383/121; 493/194; 493/231

[58] Field of Search ..... 383/104, 120, 123, 124, 383/903, 32, 8, 121; 493/194, 195, 199, 200, 203, 231, 235

[56] References Cited

U.S. PATENT DOCUMENTS

| | | | |
|---|---|---|---|
| 341,720 | 5/1886 | Bayle | 383/124 |
| 1,995,286 | 3/1935 | Arzet | 383/124 |
| 2,126,203 | 8/1938 | Miskella | 383/120 |
| 2,307,902 | 1/1943 | Vogt et al. | 383/120 |
| 2,320,326 | 5/1943 | Avery | 493/235 |
| 2,871,771 | 2/1959 | Mercer | 383/121 |
| 3,106,441 | 10/1963 | Harrison et al. | 383/121 |
| 3,119,548 | 1/1964 | Cook et al. | 383/121 |
| 3,276,670 | 10/1966 | Harvey | 383/120 |
| 3,321,354 | 5/1967 | Sloan et al. | 493/203 |
| 3,670,953 | 6/1972 | Leventhal | 383/120 |
| 3,670,954 | 6/1972 | Leventhal | 383/120 |
| 3,961,743 | 6/1976 | Hollowell | 383/120 |
| 4,164,170 | 8/1979 | Nordin | 493/194 |
| 4,326,664 | 4/1982 | Benoit et al. | 383/120 |
| 4,386,924 | 6/1983 | Crawford et al. | 493/235 |

*Primary Examiner*—Stephen P. Garbe

*Attorney, Agent, or Firm*—A. J. McKillop; M. G. Gilman; J. P. O'Sullivan, Sr.

[57] ABSTRACT

The present invention relates to a sack made of thermoplastic film, said sack having front and rear panels and an open mouth top portion, gusseted side walls wherein the innermost reach of the gusset folds overlap and at the bottom of said sack a heat seal stripe welds together all of the lay-flat layers, including the overlapped regions.

9 Claims, 6 Drawing Figures

THERMOPLASTIC BAG AND METHOD OF FORMING THE SAME

This is a continuation of copending application Ser. No. 738,629 filed on May 28, 1985 now abandoned.

The present invention relates to a thermoplastic bag structure and method for forming the same. In recent years plastic bags and sacks have appeared in increasing numbers in competition with paper bags and sacks. The many advantages plastic film sacks have over paper sacks will ultimately be responsible for the same dominating the field of bags and sacks. Features such as high tear strength, waterproof characteristics, strong integral handles, puncture resistance, high film density, cost competitiveness, etc. will make thermoplastic sacks the article of choice. The structure of thermoplastic sacks has in recent years evolved to that of a structure made by collapsing a tube of plastic so as to have two in-folded pleats or gussets at opposite sides thereof; forming a sealing transverse of the collapsed tube and simultaneously severing the tube a bag length distance from the seal to form a bag mouth opening. In order to form the bag structure, but with two double film handles, two spaced seals are positioned transverse of the collapsed tube to form what is known as a sealed pillowcase. Thereafter, from one end of the sealed tube a generally U-shaped segment is removed so as to simultaneously form two integral handles and a bag mouth opening. By this configuration and by virtue of the in-folded pleats or gussets the handles have double film thicknesses which give greater carrying strength in the handles. A forerunner of this bag has been referred to as an "undershirt" type bag, since the upper portion of the bag and handles resembles an undershirt.

With the downgauging of the film to the range of from about 0.15 to about 0.75 mils and because of the configuration of the seal area in the bottom of the bag, a problem has developed which threatens to undermine the consumer's confidence in such thermoplastic sacks. At the bottom of the above-described sacks, a heat seal stripe forms a welded closure for the bag structure. In the region of the in-folded pleat or gusset, four layers of film are brought together in the outer regions of the lay-flat bag structure and, in-between, two layers of the front and back panels of the sack are brought together. Thus, the heat seal must simultaneously weld four layers together in the outer segments of the sack and two layers together at the central region of the sack. It has been found that bags have been failing by tearing open in the region of the four and two film heat seal region in the bottom of the sack. It seems that at the seal transition from four layers to two layers at the innermost reach of both gussets a weakness has been created. As product or waste is placed in the bag, the bag gussets attempt to expand to accommodate the width dimension of the side pleats of the bag. However, the bottom, including the tip of the gusset is seal-trapped between the front and rear panels of the bag. As more and more items are loaded into the bag, strain is brought to bear at the bottom of the gusset, which ultimately results in a tear being generated at said seal transition. With more product, this tear begins to "zipper" and the material inside of the bag falls through the bottom of the bag.

It is an object of the present invention to overcome this problem.

SUMMARY OF THE INVENTION

The present invention relates to a sack made of thermoplastic film, said sack having front and rear panels, an open mouth top portion, gusseted side walls, wherein the innermost reach of the gusset folds overlap, and at the bottom of said sack a heat seal stripe welds together all of the lay-flat layers, including the overlapped regions. Because of this structure, and particularly at the point in the bottom of the bag where the gusset folds overlap, the seal stripe produces a reinforced region where the gusset tips were overlapped. Thus, while the gussets at the bottom of the bag still cannot expand to accommodate articles placed in the bag, this new configuration reinforces the bottom regions so that excellent resistance strength is given to both gussets as they attempt to expand, thus, making the seals more leakproof.

The method of forming the above described sacks comprises collapsing a tube of thermoplastic film while simultaneously forming gussets in opposite sides thereof, positioning the innermost reach of said gussets so as to overlap the gusset of the opposite side; forming a heat stripe transversely across the collapsed lay-flat tube; and, simultaneously therewith or subsequent thereto, forming a bag mouth opening a bag length distance away from said seal. It is to be understood that simultaneously with forming the bag mouth opening, a pair of double film handles can be formed in the bag mouth opening of said bag.

DETAILED DESCRIPTION OF THE INVENTION

Figure 1:
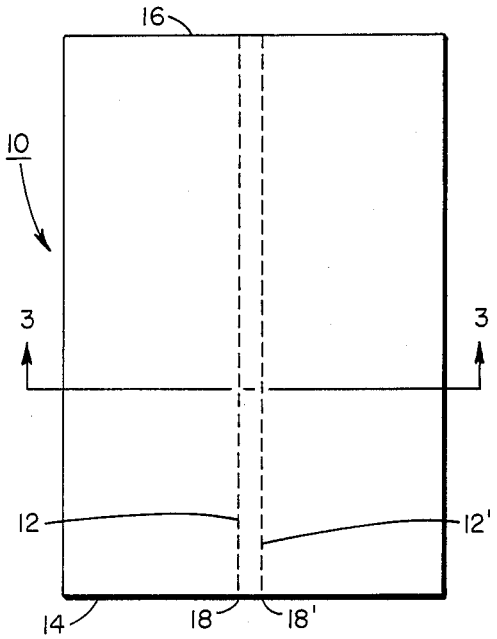
FIG. 1 PRIOR ART
FIG. 1 is a front elevation view representing a thermoplastic sack of the prior art.
Figure 3:
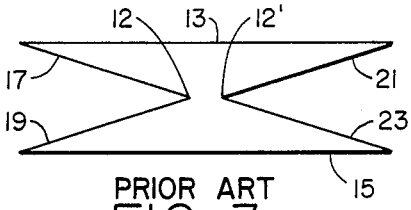
PRIOR ART FIG. 3
FIG. 3 is an end view taken along the lines 3—3 of FIG. 1.

As indicated above, FIGS. 1 and 3 represent different views of a bag structure 10 of the prior art. This bag has a front panel 13, a back panel 15, and gusseted sides represented by infolded members 17, 19, 20, 21 and 23. The gusseted members are actually single sided members creased at their longitudinal midpoints 12 and 12'. The bag has a transverse seal which forms seal line 14 which constitutes the bottom of the bag. A transverse severance line 16 illustrates the mouth of the bag. When the bag is opened at the top and filled with goods or waste of some type, the side wall gussets expand to accommodate these materials. As more material is placed in the bag the gussets ultimately expand to the maximum and a strain develops at the bottom of the bag at points 18 and 18'. It is at these points that the bottom region of the gusset is trapped in the bottom seal 14 of the bag. In the collapsed bag, seal line 14 has three distinct regions which correspond with the two outboard gusset regions which include four layers of film and the region between points 18 and 18' which include only two layers of film. As product or goods continues to attempt to expand the bottom of the gussets, a tear will develop adjacent regions 18 and 18'. It is at these points where there is a transition from four layers to two layers between points 18 and 18'. Wherever such a transition occurs with thermoplastic films an inherent weak region is formed. The product will attempt to expand the gusset and such force will attempt to pull the gusset free of points 18 and 18' with the result that a hole or tear will develop. If the overall load within the bag is dense enough, the hole will tend to "zipper" open, spilling the contents of the bag.

Figure 2:
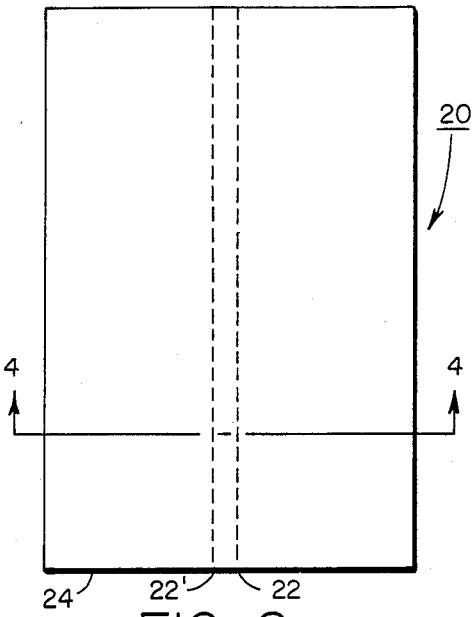
FIG. 2 is a front elevation view of one form of the thermoplastic bag structure of the present invention.
Figure 4:
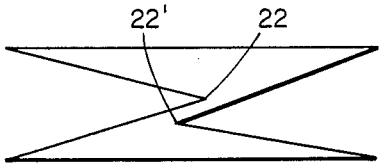
FIG. 4 is an end view taken along the lines 4—4 of FIG. 2.

FIGS. 2 and 4 of the drawing illustrates one technique of copying with this problem. Referring to FIG. 4, it will be noted that in cross-section the gusseted plastic tube is similar to that shown in FIG. 3 except that the gussets overlap to a comparatively small degree in the center. Thus, the innermost region or reach 22' invades some of the region occupied by the opposite gusset at its apex 22. When this arrangement is fully collapsed and heat sealed along line 24, the fact that regions 22 and 22' overlap presents a reinforcing amount of thermoplastic material in the center bottom seal region of the bag. Thus, when such a bag is utilized and filled with goods or refuse and the bottoms of the gusset attempt to expand, the central region of the seal is reinforced by the apex regions of the overlapped gusset and can withstand a greater amount of strain.

Figure 5:
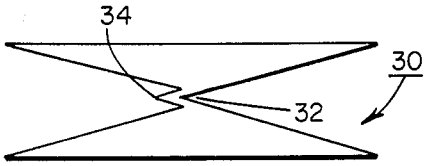
FIG. 5 is an end view of a variant form of FIG. 2.

FIG. 5 shows a variant form of the structure illustrated in FIGS. 2 and 4. In this embodiment, one gusset apex region 32 actually invades the opposite gusset apex region 34 such that apex 32 becomes overlapped by a mouth-like region 34 of the opposite gussetfold. When this structure is then completely collapsed and sealed along line 24, once again the overlapped region results in a reinforcement in the center region of the seal line. This reinforcement tends to resist a tearing as the gussets naturally attempt to expand as product is placed in the bag.

Figure 6:
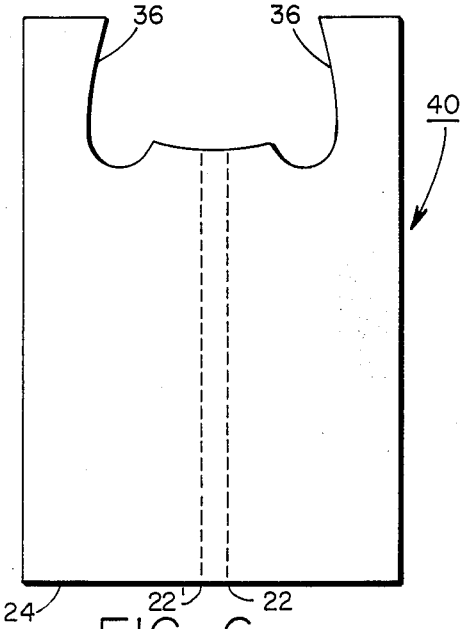
FIG. 6 is a front elevational view representing a handle version of the bag of the present invention.

FIG. 6 shows a bag 40 having pair of spaced double film handles 36. It is otherwise the same as shown in FIGS. 2 and 4.

By the foregong technique and any equivalent means of reinforcing the bottom seal, the problem of seal line weakness is overcome.

The bags of the present invention can be made with conventional bag making equipment modified in order to create the overlap in the opposing gussets. It is also to be understood that the mouth of the bag can be constructed so as to have handles therein. This can be accomplished by forming a seal across the top of the bag and, thereafter, removing a generally U-shaped area in the center top of the bag in a manner well understood by those skilled in the art. This will result in the formation, not only of the bag mouth opening, but of oppositely disposed handles having double films by virtue of the gusseted arrangement.

While the contemplated bags can be made of any thermoplastic material, polyethylene and polyethylene blends are preferred. The term polyethylene, is employed herein in its generic sense to include low density polyethylene (LDPE) having a density of from about 0.910–0.939, linear low density polyethylene (LLDPE), which actually is a copolymer of ethylene and another alpha olefin, having a density ranging from about 0.910–0.939, high molecular weight, high density polyethylene (HDPE) having a density ranging from about 0.940–0.970 and any blends thereof. Ultra low density polyethylene, a material which will be coming into commercial use in the future is also contemplated. This material will have a density of less than 0.910. A preferred material for handled grocery sacks is a blend of LLDPE and LDPE with the later being present in from about 0–20% by weight. When employing this material, the film gauge can range from about less than 0.15 to 2 mils or more in thickness. Another preferred polyethylene resin is high density polyethylene (HDPE) alone or in combination with from about 0 to 50 wt.% of LLDPE. A preferred combination is a blend of the two which would yield a density of from 0.945–0.955 g/cc.

What is claimed is:

1. A sack made of thermoplastic film, said sack having front and rear panels, an open mouth top portion, two gussetted side walls at opposite sides thereof wherein the innermost reach of the gussetted folds overlap to a comparatively small degree, and at the bottom of said sack is a heat seal weld of all of the layers in their lay-flat condition, including the overlapped regions.

2. The sack of claim 1 wherein the overlap region involves up to about 1.5 inches or more of each gusset fold.

3. The sack of claim 1 wherein the tip of one gusset invades the tip of the other gusset.

4. The sack of claim 1 wherein the film is from less than about 0.15 to greater than 2 mils in thickness.

5. The sack of claim 1 having double film thickness handles at opposite ends of a bag mouth opening, said handles being integral extensions of said front, rear and side walls.

6. The sack of claim 1 wherein said film comprises a polyolefin.

7. The sack of claim 6 wherein said polyolefin is a polyethylene.

8. The method of forming a thermoplastic sack comprising:

(a) forming a thermoplastic tube;

(b) collapsing said tube to a lay-flat condition while simultaneously forming therein oppositely disposed gusset folds wherein the innermost reach or apex of the folds overlap to a comparatively small degree;

(c) forming a transverse seal welding together all of the lay-flat layers; including the overlapped regions; and (d) simultaneously or subsequently forming a bag mouth opening a bag length distance from said heat seal.

9. The method of claim 8 wherein simultaneously with forming said bag mouth opening, forming oppositely disposed double film handles at opposite ends of said bag mouth opening.

* * * * *